US010718483B2

(12) United States Patent
Fischer

(10) Patent No.: US 10,718,483 B2
(45) Date of Patent: Jul. 21, 2020

(54) LIGHTING DEVICE FOR VEHICLES HAVING A MICRO-OPTICAL ARRAY INCLUDING AT LEAST A FIRST SUBARRAY AND A SECOND SUBARRAY WITH DIFFERENT PARTIAL LIGHT DISTRIBUTIONS

(71) Applicant: HELLA GmbH & Co. KGaA, Lippstadt (DE)

(72) Inventor: Bernd Fischer, Altenbeken (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/366,483

(22) Filed: Mar. 27, 2019

(65) Prior Publication Data

US 2019/0301699 A1 Oct. 3, 2019

(30) Foreign Application Priority Data

Mar. 27, 2018 (DE) ..... 10 2018 107 214

(51) Int. Cl.
*F21S 41/63* (2018.01)
*F21S 41/143* (2018.01)
*F21S 41/20* (2018.01)

(52) U.S. Cl.
CPC ..... *F21S 41/63* (2018.01); *F21S 41/143* (2018.01); *F21S 41/20* (2018.01)

(58) Field of Classification Search
CPC ..... F21S 41/63; F21S 41/143; F21S 41/20
See application file for complete search history.

(56) References Cited

U.S. PATENT DOCUMENTS 7,077,552 B2 * 7/2006 Ishida ..... B60Q 1/12 362/545
7,433,122 B2 * 10/2008 Peterson ..... G03B 21/602 359/443
7,437,050 B2 * 10/2008 Bourdin ..... F21S 43/237 385/146
9,951,919 B2 4/2018 Bauer et al.
(Continued)

FOREIGN PATENT DOCUMENTS

DE 102005041234 A1 3/2007
DE 102015121691 A1 6/2017
WO WO2015058227 A1 4/2015

*Primary Examiner* — Tracie Y Green
(74) *Attorney, Agent, or Firm* — Muncy, Geissler, Olds & Lowe, P.C.

(57) ABSTRACT

A lighting device for vehicles having a light source unit containing a number of light sources, having an optical unit that is arranged in front of the light source unit in the primary direction of emission for generating a predetermined light distribution, wherein the optical unit has a micro-optical array with a multiplicity of micro-optical elements arranged in a matrix, wherein a first subarray of the micro-optical array is designed without optics to form a first partial light distribution with a light/dark boundary and with a luminance maximum in a region close to the light/dark boundary, in that at least a second subarray of the micro-optical array has such micro-optical elements. A second partial light distribution is formed below the first partial light distribution in the vertical direction. The light distribution is formed by superimposing the first partial light distribution and the additional partial light distribution.

13 Claims, 3 Drawing Sheets

(56) References Cited

U.S. PATENT DOCUMENTS

| | | | | |
|---|---|---|---|---|
| 2008/0239746 | A1 | 10/2008 | Wuller et al. | |
| 2016/0025291 | A1* | 1/2016 | Iwasaki | F21S 41/143 362/516 |
| 2016/0265733 | A1* | 9/2016 | Bauer | G02B 3/0006 |
| 2018/0335191 | A1* | 11/2018 | Stefanov | F21S 41/16 |
| 2019/0143885 | A1* | 5/2019 | Sugimoto | B60Q 1/143 362/466 |

* cited by examiner

LIGHTING DEVICE FOR VEHICLES HAVING A MICRO-OPTICAL ARRAY INCLUDING AT LEAST A FIRST SUBARRAY AND A SECOND SUBARRAY WITH DIFFERENT PARTIAL LIGHT DISTRIBUTIONS

This nonprovisional application claims priority under 35 U.S.C. § 119(a) to German Patent Application No. 10 2018 107 214.7, which was filed in Germany on Mar. 27, 2018, and which is herein incorporated by reference.

BACKGROUND OF THE INVENTION

Field of the Invention

The present invention relates to a lighting device for vehicles having a light source unit containing a plurality of light sources, having an optical unit that is arranged in front of the light source unit in the primary direction of emission for generating a predetermined light distribution, wherein the optical unit has a micro-optical array with a multiplicity of micro-optical elements arranged in a matrix.

Description of the Background Art

A lighting device for vehicles is known from DE 10 2005 041 234 A1, which corresponds to US 2008/0239746, which is incorporated herein by reference, and includes multiple light source units and multiple optical units. The optical units have different projection characteristics so that light sources of the light source units are projected to different partial light distributions. Because of the different projection characteristics, a second partial light distribution has smaller spots of light than a first partial light distribution. The smaller spots of light can be used for a light concentration so that a light center of the light distribution can be located in a region close to a light/dark boundary of the light distribution.

A disadvantage of a conventional lighting device is that it requires a relatively large installation space.

Known from WO 2015/058227 A1, which corresponds to U.S. Pat. No. 9,951,919, is a lighting device for vehicles with a light source unit containing a light source and an optical unit for producing a predetermined light distribution, wherein the optical unit has a micro-optical array with a multiplicity of micro-optical elements arranged in a matrix. The micro-optical array is part of a projection optical system, which has a first micro-optical array on a light incident side, and a second micro-optical array on a light emergent side. Located between the first micro-optical array and the second micro-optical array is a mask array with mask elements, onto which the micro-optical elements of the first micro-optical array and of the second micro-optical array are directed, thereby achieving the projection of the mask elements in the light distribution. The light is pre-shaped in the micro-optical elements of the first micro-optical array, and is projected by the micro-optical elements of the second micro-optical array. Each micro-optical element of the first micro-optical array is assigned to exactly one micro-optical element of the second micro-optical array. A disadvantage of the known lighting device is that the cost for the projection of the mask elements is relatively expensive.

SUMMARY OF THE INVENTION

It is therefore an object of the present invention to provide a lighting device for vehicles having a micro-optical unit containing a micro-optical array such that a predetermined light distribution can be created in a manner that saves installation space, wherein a reduced overall height of the lighting device is achieved, in particular.

In an exemplary embodiment of the invention provided is a first subarray of the micro-optical array is designed without optics to form a first partial light distribution with a light/dark boundary and with a luminance maximum in a region close to the light/dark boundary, in that at least a second subarray of the micro-optical array has such micro-optical elements, in that a second partial light distribution is formed below the first partial light distribution in the vertical direction, wherein a luminance maximum of the second partial light distribution is located below the luminance maximum of the first partial light distribution in the vertical direction, in that the light distribution is formed by superimposing the first partial light distribution and the additional partial light distribution.

A micro-optical array can have multiple subarrays that are distinguished in that they have differently designed micro-optical elements. Preferably, the micro-optical elements of each subarray are identical in design. The micro-optical elements of the subarrays are structured such that different partial light distributions are produced that are superimposed to make the light distribution. It is advantageously possible by this means to arrange a light center or a luminance maximum of the light distribution in a region close to a light/dark boundary of the same. As a result, the invention makes possible a relatively homogeneous light distribution in conformity with legal requirements as well as a lighting device with a small overall height. The overall height can be in the range of 15 mm. The invention permits optimization of the light distribution with simple optics.

The micro-optical array can have three subarrays, wherein a first subarray is provided with optics-free micro-optical elements for producing a first partial light distribution, and the second subarray and third subarray are provided with micro-optical elements such that a second partial light distribution is located below a first partial light distribution essentially in the vertical direction, and a third partial light distribution is located essentially below the second partial light distribution. Advantageously, an optimization of the light distribution can be achieved by this means.

The optical unit can have an additional second micro-optical array with a multiplicity of micro-optical elements arranged in a matrix-like manner that preferably are identical in design and deflect the light striking them in a horizontal direction.

The first micro-optical array, which is formed of multiple subarrays, has prismatic micro-optical elements in the second and third subarrays, wherein the prismatic micro-optical elements of the second subarray are arranged to be inclined differently with respect to a vertical plane than the prismatic micro-optical elements of the third subarray. A vertical deflection of the light is accomplished by means of the first micro-optical array. A horizontal deflection of the light is accomplished by means of the second micro-optical array. Advantageously, the predetermined light distribution can be produced from a parallel light beam by the two micro-optical arrays.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
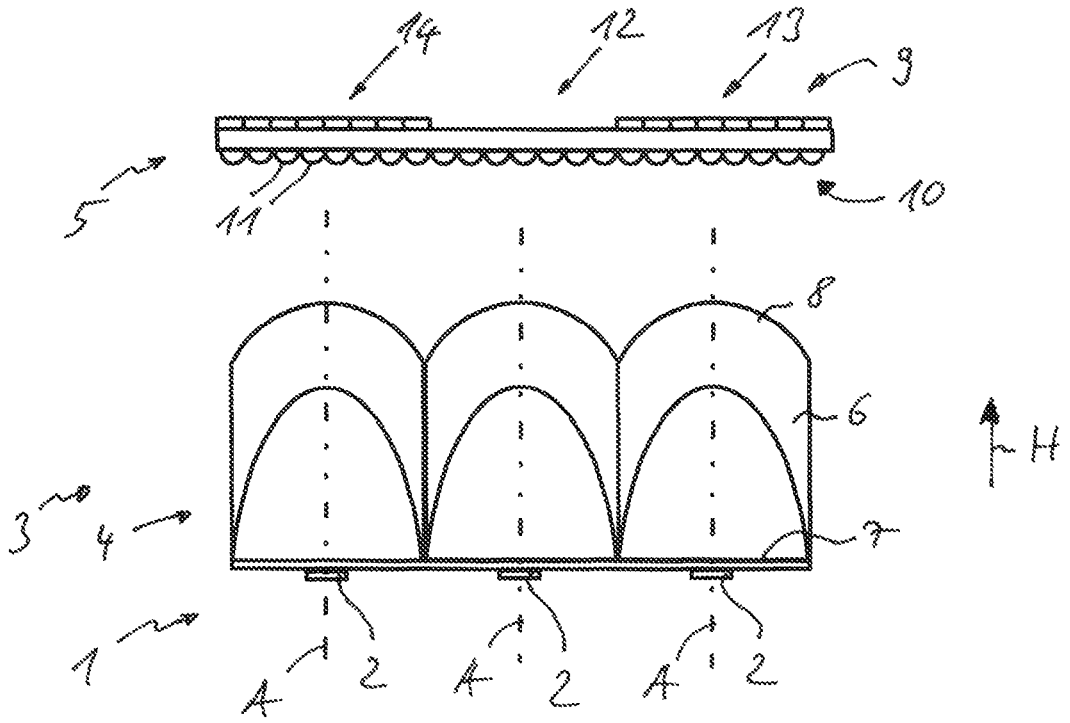
FIG. 1 shows a top view of a lighting device according to the invention.
Figure 2:
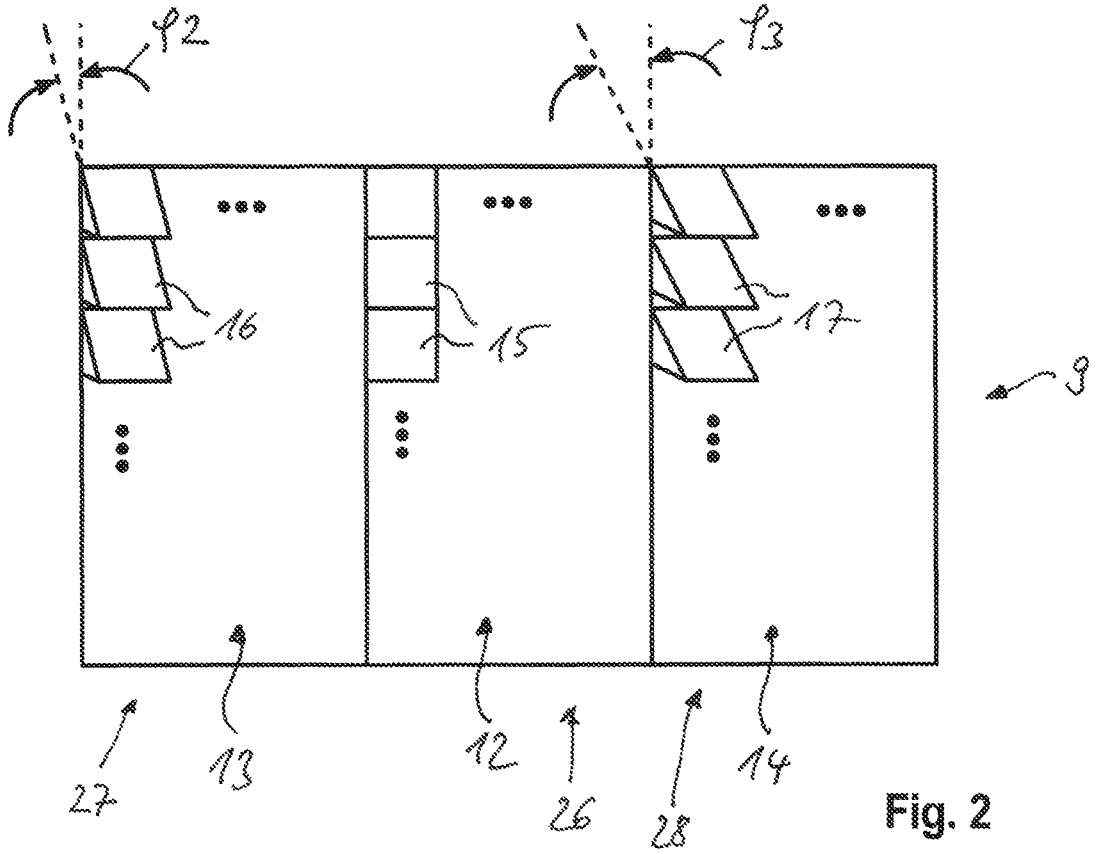
FIG. 2 shows a schematic front view of a micro-optical array having three subarrays of different micro-optical elements.

A lighting device according to the invention for vehicles can be implemented as a headlight that is located, for example, in a front end region of a motor vehicle.

The lighting device has a light source unit 1 with a multiplicity of light sources 2. The light sources 2 are implemented as LED light sources. They can be applied as light source chips to a printed circuit board that is not shown.

Located in front of the light source unit 1 in the primary direction of emission H is an optical unit 3, which includes a lighting optical system 4 for parallelizing a light emitted by the light source unit 1 and a projection optical system 5 for projecting the light sources 2 in a near field of the vehicle or onto a measuring screen.

The lighting optical system 4 has a number of collimators 6 that are arranged next to one another. The collimators 6 each have a preferably flat light incident face 7 and a curved light emergent face 8. The light source 2 in each case is located directly at the light incident face 7 or in the vicinity of the light incident face 7. The light emergent face 8 is shaped such that its focal point coincides with the location of the light source 2. In this way, parallel light emerges in each case from the collimators 6 and strikes a light incident side of the projection optical system 5.

The projection optical system 5 has a first micro-optical array 9 at a light emergent side, and a second micro-optical array 10 at a light incident side, which is to say the side facing the lighting optical system 4.

The second micro-optical array 10 has a multiplicity of micro-optical elements 11 arranged in a matrix-like manner, by means of which the light striking them is deflected in a horizontal direction. The micro-optical elements 11 can be designed as cylindrical micro-optical elements. The micro-optical elements 11 of the second micro-optical element 10 are identical in design over the entire area thereof. For example, the micro-optical elements 11 can be strip-like in design, wherein they each extend from a top to a bottom of the second micro-optical array 10. The micro-optical elements 11 are designed such that the incident, parallelized light is fanned out in a horizontal angle range of +/−30°.

The first micro-optical array 9 has a first subarray 12 with optics-free micro-elements 15, a second subarray 13 with micro-optical elements 16 arranged in a matrix and having a first vertical deflection, and a third subarray 14 with micro-optical elements 17 arranged in a matrix and having a second vertical deflection.

Figure 3A:
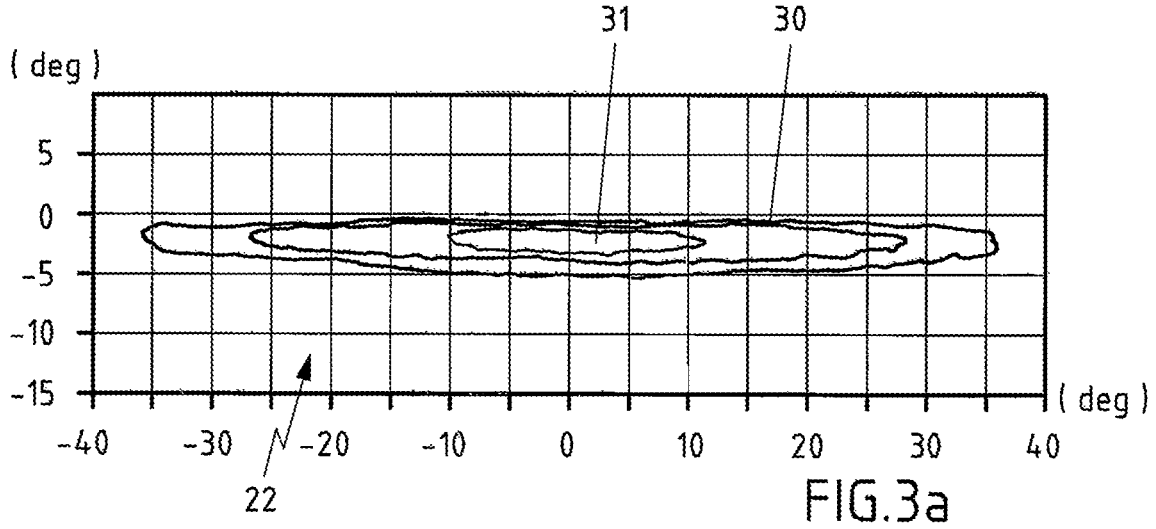
FIG. 3*a* is a first partial light distribution with a light center that is close to a light/dark boundary and that is created by means of a first subarray of the micro-optical array.

The first subarray 12 of the first micro-optical array 9 has no structuring of the surface. The first subarray 12 is made essentially of a flat surface so that it is composed of optics-free micro-optical elements 15. The light striking the first subarray 12 is projected as shown in FIG. 3*a* in accordance with a first partial light distribution 22 that is set up on a measuring screen at a distance of 25 m from the vehicle. As a result of the first partial light distribution 22, a light/dark boundary 30 and a luminance maximum 31 in the vicinity of the light/dark boundary 30 of a resultant light distribution 25 are formed as a symmetrical low beam light distribution that is composed of the first partial light distribution 22, the second partial light distribution 23, and the third partial light distribution 24.

Figure 3B:
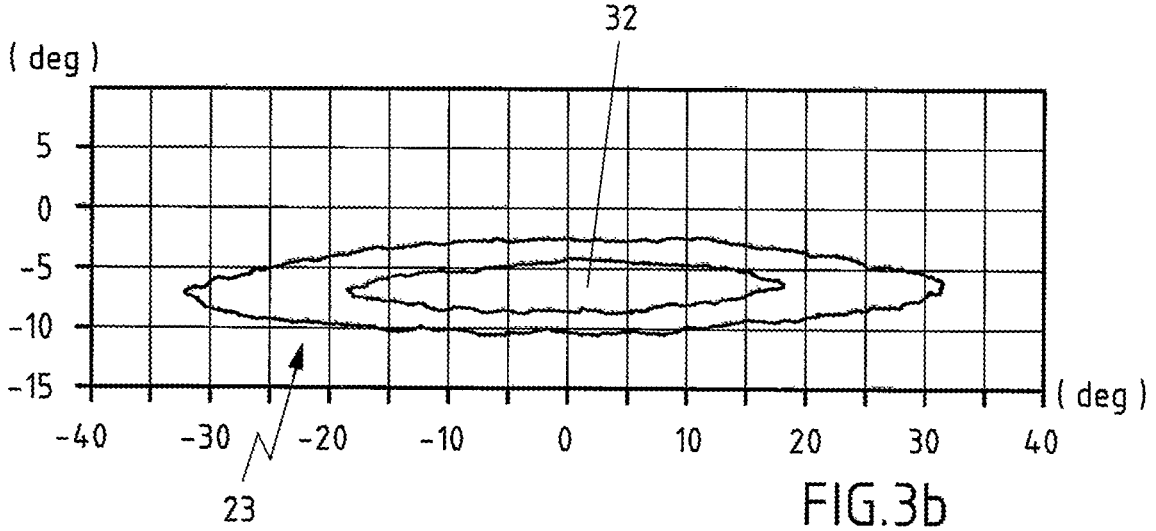
FIG. 3*b* is a second partial light distribution with a light center below the first partial light distribution from FIG. 3*a*, wherein the second partial light distribution is created by means of a second subarray of the micro-optical array.
Figure 3C:
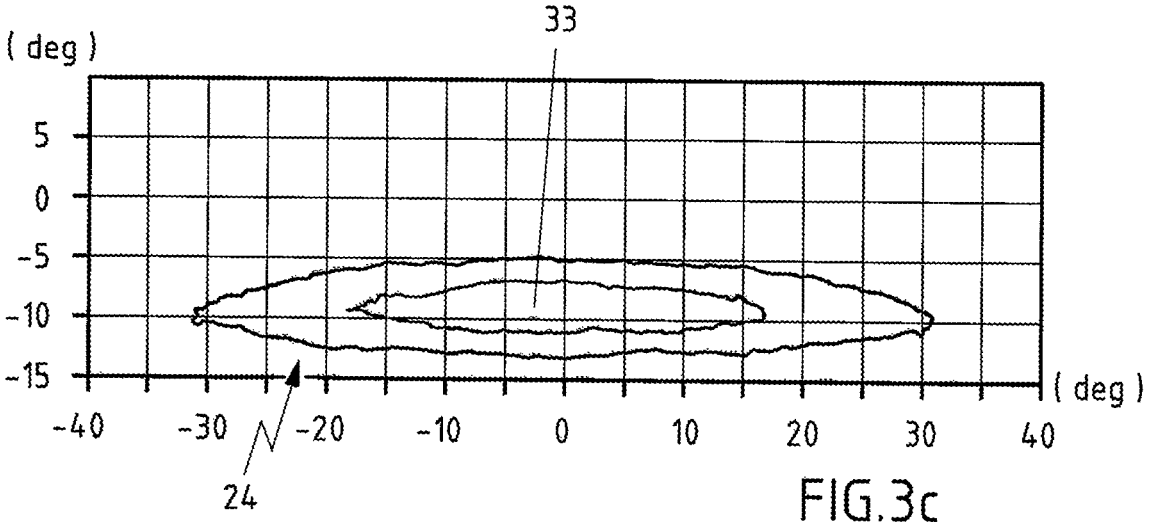
FIG. 3*c* is a third partial light distribution with a light center below the second partial light distribution from FIG. 3*b*, wherein the third partial light distribution is created by means of a third subarray of the micro-optical array.
Figure 3D:
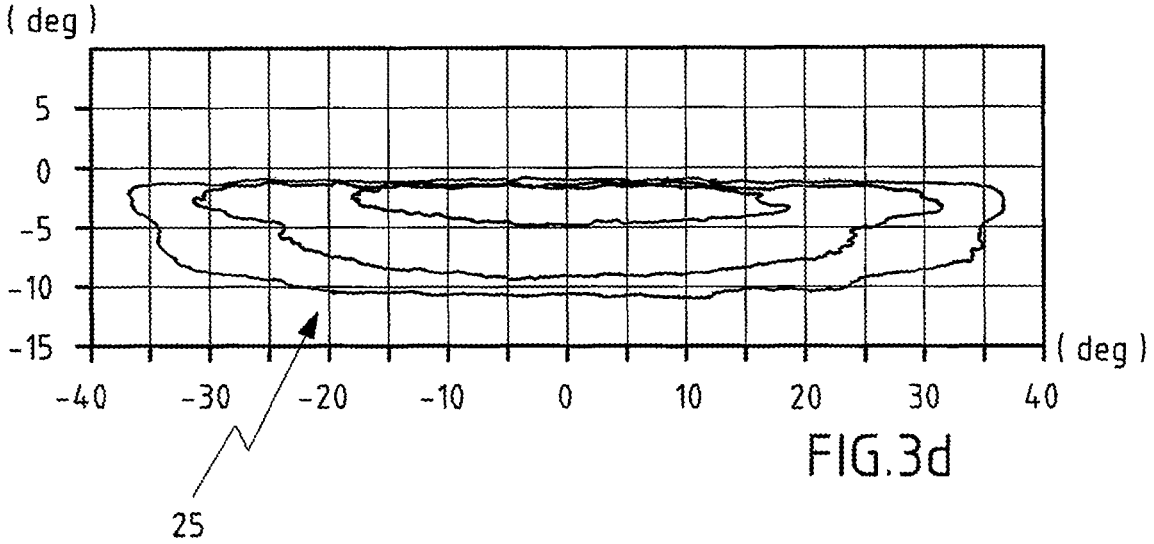
FIG. 3*d* is a light distribution of the lighting device that is formed by superimposing the first partial light distribution from FIG. 3*a*, the second partial light distribution from FIG. 3*b*, and the third partial light distribution from FIG. 3*c*.

The micro-optical elements 16 of the second subarray 13 are designed as prismatic micro-optical elements, which in the present exemplary embodiment enclose a tilt angle φ2 of 6° with respect to a vertical, and thereby create the second partial light distribution 23 as in FIG. 3*b*. The second partial light distribution 23 is located essentially below the first partial light distribution 22. In particular, a luminance maximum 32 of the second partial light distribution 23 is located below the luminance maximum 31 of the first partial light distribution 22.

The micro-optical elements 17 of the third subarray 14 are designed as prismatic micro-optical elements, which each enclose a tilt angle φ3 of 9° with a vertical. The tilt angle φ3 of the third subarray 14 is thus greater than the tilt angle φ2 of the second subarray 13, so that the third partial light distribution 24, which is located essentially below the second partial light distribution 23, is created by means of the third subarray 14. The third partial light distribution 24 has a luminance maximum 33 that is below the luminance maximum 31 of the first partial light distribution 22 and below the luminance maximum 32 of the second partial light distribution 23.

Advantageously, a raising of the centroid of the light distribution 25 into the vicinity of the light/dark boundary 30 can be achieved, in particular through the optics-free first subarray 12. The light/dark boundary 30 can be projected more sharply in this way. For example, the first subarray 12 can be arranged in a horizontal center 26 of the first micro-optical array 9. The second subarray 13 can, for example, be arranged on a right side 27 of the first micro-optical array 9 when viewed in the direction of travel or in the primary direction of emission H. The third subarray 14 can be arranged on a left side 28 of the first micro-optical array 9 when viewed in the primary direction of emission H, for example.

According to another alternative embodiment of the invention that is not shown, the first subarray 12 can also be arranged on the right side 27 or on the left side 28. Because the second micro-optical array 10 on the light incident side has identical micro-optical elements 11, the arrangement of the subarrays 12, 13, 14 relative to one another does not matter.

The luminance maximum 31 of the first partial light distribution 22 is located in a vertical angle range between −0.057° and −3°. The first subarray 12 of the first micro-optical array 9 can be arranged in a range from 25% to 35% of a total area of the first micro-optical array 9. Preferably, the area of the first micro-optical array 9 is equal to the area of the second micro-optical array 10. The first micro-optical array 9 is preferably arranged in alignment with the second micro-optical array 10 in the direction of an optical axis A of the collimators 6.

Depending on the light distribution to be created, the tilt angle φ2 or φ3 of the micro-optical element 16, 17 of the second subarray 13 or third subarray 14 can be arranged in a range from 2° to 15°, preferably 4° to 10°, with respect to a vertical plane.

The first micro-optical array 9 preferably is connected to the second micro-optical array 10 as a single piece. The projection optical system 5 composed of the first micro-optical array 9 and the second micro-optical array 10 can be made of a transparent plastic material by injection molding, for example.

According to an alternative embodiment of the invention that is not shown, the projection optical system 5 can also have only two subarrays, namely the first subarray 12 and second subarray 13. For example, the first subarray 12 can be equal in size to the second subarray 13. Alternatively, the area of the first subarray 12 can also be smaller than the area of the second subarray 13 if the light center of the light distribution is not supposed to be located so close to the light/dark boundary 30.

According to another embodiment of the invention that is not shown, the projection optical system 5 can also have more than three subarrays. The second, third, nth subarrays each have micro-optical elements that preferably are identical, wherein the different subarrays have a different tilt angle. A larger fanning of the light centers in the vertical direction can be produced as a result.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A lighting device for a vehicle comprising:

a light source unit having a plurality of light sources; and an optical unit arranged in front of the light source unit in a primary direction of emission for generating a predetermined light distribution, the optical unit having a first micro-optical array with a plurality of micro-optical elements arranged in a matrix, the first micro-optical array including a first subarray and a second subarray arranged on a light emergent side of the optical unit, wherein the first subarray of the first micro-optical array is designed without optics to form a first partial light distribution with a light/dark boundary and with a luminance maximum in a region near the light/dark boundary, wherein the second subarray of the first micro-optical array has the micro-optical elements, such that a second partial light distribution is formed below the first partial light distribution in a vertical direction, wherein a luminance maximum of the second partial light distribution is located below the luminance maximum of the first partial light distribution in the vertical direction, and wherein the predetermined light distribution is formed by superimposing the first partial light distribution and the second partial light distribution.

2. The lighting device according to claim 1, wherein the first micro-optical array further includes a third subarray with the micro-optical elements arranged on the light emergent side of the optical unit, wherein a third partial light distribution is formed below the second partial light distribution in the vertical direction, wherein a luminance maximum of the third partial light distribution is located below the luminance maximum of the second partial light distribution in the vertical direction, and wherein the predetermined light distribution is formed by superimposing the first partial light distribution, the second partial light distribution, and the third partial light distribution.

3. The lighting device according to claim 2, wherein the micro-optical elements of the second subarray and of the third subarray are prismatic, and wherein a tilt angle of the micro-optical elements of the second subarray with respect to a vertical plane is smaller than a tilt angle of the micro-optical elements of the third subarray.

4. The lighting device according to claim 1, wherein the light center of the first partial light distribution is located in a vertical angle range between −0.057° and −3°.

5. The lighting device according to claim 1, wherein the first subarray of the first micro-optical array comprises 25% to 35% of a total area of the first micro-optical array.

6. The lighting device according to claim 2, wherein the first subarray, the second subarray and the third subarray are arranged next to one another in the horizontal direction in the first micro-optical array.

7. The lighting device according to claim 3, wherein the tilt angle of the micro-optical elements of the second subarray and the tilt angle of the micro-optical elements of the third subarray are in a range from 2° to 15°, with the tilt angle of the micro-optical elements of the second subarray being smaller than the tilt angle of the micro-optical elements of the third subarray.

8. The lighting device according to claim 2, wherein a second micro-optical array with a plurality of micro-optical elements arranged in a matrix-like manner is provided such that the light striking the micro-optical elements is deflected in a horizontal direction.

9. The lighting device according to claim 8, wherein all of the micro-optical elements of the second micro-optical array are identical to each other and all of the micro-optical elements of the second subarray are identical to each other and all of the micro-optical elements of the third subarray are identical to each other.

10. The lighting device according to claim 8, wherein a lighting optical system is arranged behind the first micro-optical array and the second micro-optical array in the primary direction of emission for collimation of the light emitted by the light source unit.

11. The lighting device according to claim 3, wherein the tilt angle of the micro-optical elements of the second subarray and the tilt angle of the micro-optical elements of the third subarray are in a range from 4° to 10°, with the tilt angle of the micro-optical elements of the second subarray being smaller than the tilt angle of the micro-optical elements of the third subarray.

12. The lighting device according to claim 8, wherein the second micro-optical array is arranged on a light incident side of the optical unit.

13. The lighting device according to claim 9, wherein the micro-optical elements of the second micro-optical array are different from the micro-optical elements of the second subarray and the micro-optical elements of the second subarray are different from the micro-optical elements of the third subarray.

* * * * *